US010494690B2

(12) United States Patent
Zhai et al.

(10) Patent No.: US 10,494,690 B2
(45) Date of Patent: Dec. 3, 2019

(54) HIGH-TOUGHNESS SEAMLESS STEEL TUBE FOR AUTOMOBILE SAFETY AIRBAG AND MANUFACTURING METHOD THEREFOR

(71) Applicant: BAOSHAN IRON & STEEL CO., LTD., Shanghai (CN)

(72) Inventors: Guoli Zhai, Shanghai (CN); Qingchao Tian, Shanghai (CN); Qijiang Wang, Shanghai (CN); Cailing Liu, Shanghai (CN)

(73) Assignee: Boashan Iron & Steel Co., Ltd., Shanghai (CN)

( * ) Notice: Subject to any disclaimer, the term of this patent is extended or adjusted under 35 U.S.C. 154(b) by 244 days.

(21) Appl. No.: 15/321,189

(22) PCT Filed: Jan. 14, 2015

(86) PCT No.: PCT/CN2015/070662

§ 371 (c)(1),
(2) Date: Dec. 21, 2016

(87) PCT Pub. No.: WO2015/196792

PCT Pub. Date: Dec. 30, 2015

(65) Prior Publication Data

US 2018/0187277 A1 Jul. 5, 2018

(30) Foreign Application Priority Data

Jun. 25, 2014 (CN) ..... 2014 1 0290460

(51) Int. Cl.

| | |
|---|---|
| ***C21D 8/10*** | (2006.01) |
| ***C22C 38/48*** | (2006.01) |
| ***C22C 38/58*** | (2006.01) |
| ***C21D 9/08*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/04*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/32*** | (2006.01) |
| ***C22C 38/38*** | (2006.01) |

(52) U.S. Cl.

CPC ..... *C21D 8/105* (2013.01); *C21D 9/08* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/58* (2013.01); *C21D 2211/002* (2013.01); *C21D 2211/005* (2013.01)

(58) Field of Classification Search

CPC ..... B23K 9/23; B23K 9/0026; B23K 31/02; B23K 1/0018; B23K 9/235; B23K 2201/001; B23K 2203/08; B23P 6/045; B23P 6/007; F01D 5/005; C22F 1/10; C22C 38/38; C22C 38/26; C22C 38/24; C22C 38/22; C22C 38/20; C22C 38/04; C22C 38/44; C22C 38/46; C22C 38/02; C22C 38/06; C22C 38/32; C22C 38/48; C22C 38/58; C22C 19/055; C22C 38/42; F05D 2230/237; C21D 8/105; C21D 9/08; C21D 2211/002; C21D 2211/005

See application file for complete search history.

(56) References Cited

U.S. PATENT DOCUMENTS 6,878,219 B2 * 4/2005 Kondo ..... C21D 8/10 148/333

2008/0257459 A1 10/2008 Arai et al.

(Continued)

FOREIGN PATENT DOCUMENTS

| | | | |
|---|---|---|---|
| CA | 2800991 | A1 | 12/2011 |
| CN | 101233253 | A | 7/2008 |
| CN | 101528964 | A | 9/2009 |

(Continued)

OTHER PUBLICATIONS

PCT/CN2015/070662 International Search Report and Written Opinion, dated Apr. 20, 2015.

*Primary Examiner* — Anthony J Zimmer

(74) *Attorney, Agent, or Firm* — Thomas I Horstemeyer, LLP

(57) ABSTRACT

A high strength and toughness seamless steel tube for an automobile airbag, comprising the following elements, by wt %: C: 0.05-0.15%; Si: 0.1-0.45%; Mn: 1.0-1.9%; Ni: 0.1-0.6%; Cr: 0.05-1.0%; Mo: 0.05-0.2%; Cu: 0.05-0.50%; Al: 0.015-0.060%; Nb: 0.02-0.1%; V: 0.02-0.15%; and the balance being Fe and other inevitable impurities. A method for manufacturing the seamless steel tube comprises the steps: (1) heating a tube blank and then soaking; (2) hot piercing, reducing the diameter and the wall thickness of the tube blank with a stretch reducer and then cooling naturally; (3) annealing, pickling, phosphating and saponifying; (4) cold working to obtain a finished product size; and (5) carrying out stress relief annealing treatment.

11 Claims, No Drawings

(56) References Cited

U.S. PATENT DOCUMENTS

| | | | |
|---|---|---|---|
| 2009/0238714 | A1 | 9/2009 | Arai et al. |
| 2013/0086965 | A1 | 4/2013 | Kawamoto et al. |

FOREIGN PATENT DOCUMENTS

| | | | |
|---|---|---|---|
| CN | 104046924 | A | 9/2014 |
| JP | 2004-207303 | A | 7/2004 |
| JP | 2009-532584 | A | 9/2009 |
| JP | 2009-541589 | A | 11/2009 |
| WO | 2006/046503 | A | 5/2006 |
| WO | 2006/046702 | A | 5/2006 |
| WO | 2007/091585 | A | 8/2007 |
| WO | 2008/050628 | A | 2/2008 |
| WO | 2011/152447 | A | 12/2011 |

* cited by examiner

HIGH-TOUGHNESS SEAMLESS STEEL TUBE FOR AUTOMOBILE SAFETY AIRBAG AND MANUFACTURING METHOD THEREFOR

CROSS-REFERENCE TO RELATED APPLICATIONS

This application is a 371 U.S. National Phase of PCT International Application No. PCT/CN2015/070662, filed on Jan. 14, 2015, which claims benefit and priority to Chinese patent application No. 201410290460.2, filed on Jun. 25, 2014. Each of the above-referenced applications is incorporated by reference herein in its entirety.

FIELD OF THE INVENTION

The present application relates to a metallurgical product and a method for producing the same, in particular to a seamless steel tube and a method for producing the same.

BACKGROUND OF THE INVENTION

With the rapid growth of private cars, roads are more and more crowded, so that traffic accidents happen frequently, and therefore, the safety performance of automobiles becomes important. When a collision accident happens to a vehicle, the automobile safety air bag can alleviate the injury degree of the personnel, and the passenger and the driver are prevented from colliding a second time, or being thrown away from the seats under dangerous situations such as rolling of the vehicle. Usually, automobile air bags are arranged in the front of an automobile (in front of the driver's seat and the passenger's seat). However, in order to protect the driver's life safety, the air bags can be installed at not only the driver's seat and the passenger's seat, but also the sides of the automobile (in the front and back portions of the automobile) and the roof thereof, so that the air bags or the air curtains are installed in the three sides of the vehicle. As a result, the number of steel pipes for the air bags on each automobile is increased. In order to improve the safety performance of the automobile, the quality of the steel pipe for the air bag on the automobile can also be improved, and the steel tube is required to have high strength-toughness product and thin wall thickness, such that the requirements of safety, light weight and low cost for the vehicle can be met.

The mechanism of the automobile air bag is as follows: when a gas generator equipped with a burst agent senses a speed change caused by a collision, an ignition action is triggered according to a signal indication, such that the solid fuel is ignited, and a gas is generated to inflate the air bag, then the air bag is rapidly expanded. Thus, the impact on the human body during collision is reduced. During the manufacture of a gas generator of an air bag, the seamless steel tube is generally required to have high bursting strength, high strength-toughness product and low-temperature impact toughness.

JP2002-294339, published on Oct. 9, 2002 and entitled "A steel for air bag having excellent weldability, excellent molding, high dimensional precision, high tensile strength, and excellent burst resistance, and a method for producing same", relates to a steel for air bags and a manufacturing method thereof. The steel material comprises the following components (wt. %): C: 0.05-0.20%; Si: 0.1-1.0%; Mn: 0.20%-2.0%; P<0.025%; S<0.010%; Cr: 0.05-1.0%; Al<0.10%, Mo<0.50%; Ni<1.5%; Cu<0.5%, V<0.2%; Ti<0.1%, Nb<0.1%; B<0.005% and the balance of Fe and inevitable impurities. In the manufacturing method in the Japanese patent document, the steel tube is heated and then quenched to the temperature of the Ac1 phase transition point (at least), and then the steel tube is annealed at the temperature of the Ac1 phase transition point.

CN102304613A, published on Jan. 4, 2012 and entitled "Steel tube for air bag system and method for producing same", discloses a seamless steel tube for an air hag and a manufacturing method thereof. The steel tube comprises the following components, by wt %: C: ≤9.12%, Mn: 1.00-1.40%, S: ≤01%, P: ≤0.015%, Si: 0.15-0.35%, Ni: ≤0.25%, Cr: 0.40-0.80%, Mo: 0.30-0.60%, V: ≥0.07%, Cu: ≤0.35%, Al: 0.15-0.05%, Ne: ≤0.05%, Ti: ≤0.05%, Sn: ≤0.05%, Sb: ≤0.05%, As: ≤0.05%, Pb: ≤0.05%, and the sum of the amounts of Sn, Sb, As and Pb is ≤0.15%, and the balance of Fe. The Chinese patent document also discloses a manufacturing method of the seamless steel tube.

The manufacturing methods of the steel or the seamless steel tube disclosed by the above two patent documents need the heat treatment of quenching and tempering to the corresponding steel or the seamless steel tube in order to achieve higher tensile strength.

CN101528964A, published on Sep. 9, 2009 and entitled "Seamless steel tube for accumulator in air bag and a method for producing same", relates to a seamless steel tube and a manufacturing method thereof. The seamless steel tube comprises the following component, by wt %: C: 0.08-0.20%, Si: 0.1-1.0%, Mn: 0.6-2.0%, P: ≤0.025%, S: ≤0.010%, Cr: 0.05-1.0%, Mo: 0.05-1.0%, Al: 0.002-0.10%, at least one selected from the group consisting of Ca: 0.0003-0.01%, Mg: 0.0003-0.01%, and REM (rare earth elements): 0.0003-0.01%, and at least one selected from the group consisting of Ti: 0.002-0.1% and Nb: 0.002-0.1%, CEQ defined by the following equation (1) falling into the range of 0.45~0.63, $$CEQ=C+Si/24+Mn/6+(Cr+Mo)/5+(Ni+Cu)/15 \quad (1).$$

The above Chinese patent document used a heat treatment of normalizing and tempering to achieve high strength and high toughness. However, the above seamless steel tube contained Ca, Mg and rare earth elements, so that the manufacturing cost of the steel tube is increased.

SUMMARY OF THE INVENTION

The object of the present disclosure is to provide a high strength and toughness seamless steel tube for an automobile air bag, in which the seamless steel tube has relatively high strength and high strength-toughness product, good low-temperature toughness and low-temperature burst performance, relatively large elongation rate and low-temperature impact absorption power. Moreover, the seamless steel tube has a thin wall and a good size precision.

In order to achieve the object, the present disclosure provides a high strength and toughness seamless steel tube for an automobile air bag, comprising the following components, by wt %:

C: 0.05-0.15%;
Si: 0.1-0.45%;
Mn: 1.0-1.9%;
Ni: 0.1-0.6%;
Cr: 0.05-1.0%;
Mo: 0.05-0.2%;
Cu: 0.05-0.50%;
Al: 0.015-0.060%;
Nb: 0.02-0.1%;
V: 0.02-0.15%;
a balance of Fe and inevitable impurities.

The inevitable impurities in the technical solution according to the present application are mainly S and P. The amount of S is controlled to 0.015% or less as far as possible, and the amount of P is controlled to 0.025% or less as far as possible.

The role of each element in the high strength and toughness seamless steel tube for the automobile air bag is as follows:

C: C element is one of the main elements for improving the strength of steel. The strength of steel can be effectively improved through the formation of carbide, and the adding cost is low. When the content of C is lower than 0.05 wt %, the seamless steel tube cannot have tensile strength of 850 MPa or more, but when the content of C is higher than 0.15 wt %; the toughness, the low-temperature impact performance, the low-temperature burst performance, the welding performance and other performances of the seamless steel tube will be all affected. In the technical solution of the present disclosure, the content of the C element is controlled in the range of 0.05-0.15 wt %.

Si: Si element is used as a reducing agent and a deoxidizing agent in the process for producing steel, and the Si element does not form a carbide in the steel. The Si element has large solid solubility in the steel and can strengthen the ferrite in the steel such that the strength of the steel is increased. However, once the silicon content exceeds 0.45 wt %, the toughness of the steel tube can be greatly reduced, especially the low-temperature impact toughness; meanwhile, the welding performance of the steel tube can be reduced. Therefore, the Si content should be controlled in the range of 0.10-0.45 wt %.

Mn: Mn is an important alloying element and a weak carbide-forming element. Mn can improve the strength of steel mainly by solid-solution strengthening. Increasing the content of Mn will reduce the phase transition temperature of steel and reduce the quenching critical cooling rate. When the Mn content is 1.0 wt % or more, the hardenability of the steel can be significantly increased. However, if the Mn content exceeds 1.9 wt %, the impact toughness of the steel is obviously reduced. Therefore, in the technical solution of the present application, the Mn content should be in the range of 1.0-1.9 wt %.

Ni: Ni can not only improve the strength and hardenability of steel but also improve the toughness of the steel. Considering the cost factor of the steel, in the embodiment of the present disclosure, the content of Ni is controlled in the range of 0.1-0.6 wt % such that it can achieve the ideal strengthening effect in combination with other elements, while increasing the toughness of the steel.

Cr: Cr is a medium or strong carbide-forming element. A part of Cr in the steel is replaced by iron to form an alloy cementite so as to improve the stability thereof; the other part is dissolved in the ferrite to achieve the effect of solid-solution strengthening, thereby increasing the strength and hardness of the ferrite. Meanwhile, Cr is the main element for improving hardenability of steel. However, when the Cr content exceeds 1.0 wt %, the toughness of the welded part can be influenced. Considering the cost for adding Cr, the Cr content in the high strength and toughness seamless steel tube for the automobile air hag according to the disclosure is controlled to 0.05-1.0 wt %.

Mo: Mo has a solid-solution strengthening effect in steel and improves hardenability of steel. When the Mo content reaches 0.05 wt %, the effect of the solid-solution strengthening and improving the hardenability can be achieved markedly. Only when the Mo content exceeds a certain range, the toughness of the welded part of the steel tube can be influenced. Meanwhile, considering the cost, the Mo content in the high strength and toughness seamless steel tube for the automobile air bag according to the present disclosure is controlled in the range of 0.05-0.2 wt %.

Cu: Cu can improve the toughness of steel. The corresponding effect can be obtained even if the Cu content is relative small. If the Cu content exceeds 0.50 wt %, the hot workability of the steel can be greatly affected. The hot workability of the steel tube cannot be ensured even if an additive element(s) is added. Thus, it is desirable in the technical solution of the present disclosure to control the Cu content in the range of 0.05-0.50 wt %.

Al: Al has a deoxidation effect in steel and can improve the toughness and workability of steel. When the Al content reaches 0.015 wt % or above, the effect of improving the toughness and workability of steel is significant, but when the Al content exceeds 0.060 wt %, the tendency of cracking in the steel is increased. According to the present disclosure, the Al content is controlled to 0.015-0.060 wt %.

Nb: Nb has the effect of improving the toughness of steel. When the Nb content is greater than or equal to 0.02 wt %, the effect of improving the toughness is significant. However, when the Nb content is larger than 0.1 wt %, the toughness of the steel is reduced. Thus, it should be desirable in the technical solution of the present invention to control the Nb content in 0.02-0.1 wt %.

V: V is a strong carbide-forming element, and has strong capability of binding with carbon. The resulting fine and dispersed VC particles has an effect of dispersion strengthening, such that the strength of steel is significantly increased. If the V content is less than 0.02 wt %, the effect of dispersion strengthening is not obvious, but if the V content is greater than 0.15 wt %, the workability of the steel can also be affected. As a result, the V content in steel should be controlled to 0.02-0.1.5 wt %.

The high strength and toughness seamless steel tube for an automobile air bag according to the present disclosure does not contain expensive elements such as Ca, Mg or rare earth metals. By optimization of the elements as well as the process for production, the high strength and toughness seamless steel tube for an automobile air bag according to the disclosure has high strength, high strength-toughness product, good low-temperature toughness, good low-temperature burst performance, large elongation rate and low-temperature impact absorption power.

Further, the high strength and toughness seamless steel tube for an automobile air bag according to the present disclosure further comprises ≤0.005 wt % of B element.

By adding a trace amount of B into the steel, the hardenability of the steel can be remarkably improved, and the process performance and the mechanical property of the steel are improved. Therefore, a suitable amount of B element is added into the high strength and toughness seamless steel tube for an automobile air bag according to the present disclosure, and the B content is controlled to ≤0.005 wt %.

Further, the high strength and toughness seamless steel tube for an automobile air bag according to the present disclosure has a wall thickness of 1.5 mm or more.

Further, the high strength and toughness seamless steel tube for an automobile air bag according to the present disclosure has an outer diameter of 15-50 mm.

Further, the high strength and toughness seamless steel tube for an automobile air bag according to the present disclosure has a microstructure of ferrite+lower bainite.

Accordingly, another object of the present disclosure is to provide a method for producing the high strength and toughness seamless steel tube for an automobile air bag, comprising the following steps:

(1) heating a tube blank and then soaking;

(2) hot piercing, reducing the diameter and the wall thickness of the tube blank with a stretch reducer and then cooling naturally;

(3) annealing, pickling, phosphating and saponifying;

(4) cold working to obtain a finished product size;

(5) carrying out stress relief annealing treatment.

The manufacturing method of a high strength and toughness seamless steel tube for an automobile air bag according to the present disclosure does not use the complicated heat treatment of quenching and tempering, and the high-strength and high-toughness seamless steel tube with good low-temperature toughness and low-temperature burst property is obtained by a simple and economic stress relief annealing heat treatment. This simplifies the process steps of the manufacturing method of the seamless steel tube and avoids the case that a seamless steel tube cannot meet the high dimensional precision requirement of an automobile air bag product due to large deformation caused by the quenching process. The tensile strength, plasticity and toughness of the steel tube can be ensured by the stress relief annealing heat treatment.

Furthermore, according to the manufacturing method of the high strength and toughness seamless steel tube for an automobile air bag according to the present disclosure, in the above step (1), the tube blank is heated to 1220-1260° C. and is soaked for 10-20 minutes.

Furthermore, according to the manufacturing method of the high strength and toughness seamless steel tube for an automobile air bag according to the present disclosure, in the above step (4), the cold working is carried out by cold drawing or cold rolling.

The cold drawing or cold rolling is used to process the steel tube to a given size, so as to reduce the stress generated in the cold working process.

Furthermore, according to the manufacturing method of the high strength and toughness seamless steel tube for the automobile air bag according to the present disclosure, in the above step (4), the extension coefficient of each nm of the cold working is less than or equal to 1.5, so as to ensure the production efficiency of the steel tube, while avoiding the defects such as cracks after cold working the steel tube.

Furthermore, according to the manufacturing method of the high strength and toughness seamless steel tube for an automobile air bag according to the present disclosure, in the above step (4), an extension coefficient of the last run of the cold working is larger than or equal to 1.4, so as to ensure the strength of the steel tube caused by the cold working, before final heat treatment.

Furthermore, according to the manufacturing method of the high strength and toughness seamless steel tube for an automobile air bag according to the present disclosure, in the above step (5), the temperature of the stress relief annealing treatment is 680-780° C. and is held for 10-20 min.

If the temperature of the stress relief annealing treatment is too high, or the hold time is too long, the finished steel tube has large grains such that the strength and the hardness of the steel tube cannot meet the requirements. However, if the temperature of the heating is too low, the precipitated carbide cannot be sufficiently dissolved and cannot achieve the strengthening effect. As a result, in the manufacturing method of the high strength and toughness seamless steel tube for an automobile air bag according to the present disclosure, the temperature of the stress relief annealing is 680-780° C., and the hold time is controlled to 10-20 min, such that the carbide in the steel can be precipitated out within a short time in order to achieve the effect of solid-solution strengthening; meanwhile, the grain growth can be inhibited so as to improve the strength and toughness of the steel. The final performance of the seamless steel tube can meet the requirements of the automobile air bag.

Owing to the use of the above technical solution, the high-toughness seamless steel tube for an automobile air bag according to the present disclosure has high strength, high strength-toughness product, good low-temperature toughness and low-temperature burst performance, relatively large elongation rate and low-temperature impact absorption power. The steel tube has a tensile strength of 850 MPa or more, a low-temperature impact absorption power at −60° C. of 15 J or more, and an elongation of 18% or more.

In addition, the high strength and toughness seamless steel tube for an automobile air bag according to the present disclosure has a thin wall, light weight, and high precision such that it can meet the requirements of a lightweight vehicle system.

In addition, the high strength and toughness seamless steel tube for an automobile air bag according to the present disclosure does not contain expensive metals, so it has low cost for production.

The manufacturing method of the high strength and toughness seamless steel tube for an automobile air bag according to the present disclosure can produce a seamless steel tube having high tensile strength, high strength-toughness product, good low-temperature toughness, good low-temperature burst performance, large elongation rate and good low-temperature impact absorption power.

In addition, the manufacturing method of the high-strength and toughness seamless steel tube for an automobile air bag according to the present disclosure ensures the production efficiency of the steel tube and avoids cracking of the steel tube effectively by controlling the elongation coefficient of each run of the cold working.

BEST MODES OF EMBODIMENTS OF THE INVENTION

The following describes the high strength and toughness seamless steel tube for an automobile air bag according to the present disclosure and the manufacturing method thereof according to the specific embodiments. However, the present disclosure is not limited to the specific embodiments and the related description.

Examples A1-A10 and Comparative Examples B1-B6

According to the following steps, the high strength and toughness seamless steel tubes A1-A1 of the present disclosure and Comparative Examples B1-B6 were produced, the method comprising the following steps:

(1) smelting and preparing a tube blank with the weight percentages of elements in the steel as shown in Table 1;

(2) heating the tube blank to 1220-1260° C. in an annular heating furnace, and soaking for 10-20 minutes;

(3) hot piercing with a vertical-type conical heat piercer and reducing the diameter and thickness of the tube blank by a three-roller stretch reducer and then naturally cooling;

(4) carrying out intermediate annealing heat treatment after pickling and then carrying out phosphating and saponifying;

(5) cold working to obtain a finished product by cold drawing or cold rolling, wherein the elongation coefficient of each run of the cold working was less than or equal to 1.5, and the elongation coefficient of the last run of the cold working was in the range of 1.4-1.5; wherein the cold-worked steel tube had a wall thickness of 1.5-5 mm and an outer diameter of 15-50 m;

(6) carrying out stress relief annealing treatment at a temperature of 680-780° C. for 10-20 min, and then carrying out air cooling.

It should be noted that a proper intermediate heat treatment process may be carried out before the above step (5) in order to ensure the cold workability of the steel tube.

Table 1 lists the weight percentages of the elements in Examples A1-A10 and Comparative Examples B1-B6.

TABLE 1

(wt %, the balance of Fe and inevitable impurities)

| No. | C | Si | Mn | Ni | Cr | Mo | Cu | Al | Nb | V | B |
|---|---|---|---|---|---|---|---|---|---|---|---|
| A1 | 0.10 | 0.35 | 1.7 | 0.3 | 0.10 | 0.10 | 0.08 | 0.02 | 0.05 | 0.06 | 0.003 |
| A2 | 0.11 | 0.38 | 1.8 | 0.4 | 1.0 | 0.05 | 0.06 | 0.03 | 0.06 | 0.08 | 0.003 |
| A3 | 0.05 | 0.45 | 1.9 | 0.5 | 0.10 | 0.09 | 0.08 | 0.02 | 0.05 | 0.10 | — |
| A4 | 0.11 | 0.40 | 1.3 | 0.5 | 0.18 | 0.15 | 0.09 | 0.03 | 0.06 | 0.10 | 0.003 |
| A5 | 0.12 | 0.33 | 1.4 | 0.5 | 0.05 | 0.07 | 0.10 | 0.05 | 0.04 | 0.09 | 0.005 |
| A6 | 0.10 | 0.37 | 1.8 | 0.6 | 0.20 | 0.18 | 0.12 | 0.02 | 0.02 | 0.07 | 0.005 |
| A7 | 0.11 | 0.39 | 1.6 | 0.4 | 0.25 | 0.11 | 0.09 | 0.02 | 0.04 | 0.06 | 0.004 |
| A8 | 0.13 | 0.32 | 1.5 | 0.3 | 0.22 | 0.10 | 0.08 | 0.04 | 0.06 | 0.08 | 0.005 |
| A9 | 0.09 | 0.35 | 1.4 | 0.2 | 0.19 | 0 13 | 0.06 | 0.02 | 0.08 | 0.02 | 0.005 |
| A10 | 0.10 | 0.36 | 1.1 | 0.5 | 0.16 | 0.15 | 0.07 | 0.03 | 0.05 | 0.07 | 0.005 |
| B1 | 0.15 | 0.39 | 0.8 | 0.3 | 0.18 | 0.15 | 0.10 | 0.03 | 0.07 | 0.10 | 0.003 |
| B2 | 0.12 | 0.38 | 1.7 | — | 0.04 | 0.13 | 0.08 | 0.02 | 0.03 | 0.08 | 0.030 |
| B3 | 0.2 | 0.38 | 2.0 | 0.3 | 0.95 | 0.01 | 0.08 | 0.03 | 0.08 | 0.09 | 0.010 |
| B4 | 0.14 | 0.36 | 0.8 | 0.4 | 0.18 | 0.15 | 0.09 | 0.04 | — | 0.08 | 0.003 |
| B5 | 0.13 | 0.38 | 1.6 | 0.3 | 0.09 | 0.11 | 0.11 | 0.03 | 0.09 | — | 0.004 |
| B6 | 0.12 | 0.37 | 1.4 | 0.5 | 0.25 | 0.11 | 0.09 | 0.03 | 0.08 | 0.06 | 0.004 |

Table 2 lists the process parameters for the various steps in Examples A1-A10 and Comparative Examples B1-B6.

TABLE 2

| No. | Step(2) Temperature of heating (° C.) | Step(2) Time for soaking (min) | Step(5) Elongation coefficient of the last run of cold working | Step(5) Thickness of steel tube wall (mm) | Step(5) Outer diameter of steel tube (mm) | Step(6) Temperature of annealing (° C.) | Step(6) Hold time (min) |
|---|---|---|---|---|---|---|---|
| A1 | 1260 | 12 | 1.42 | 1.8 | 20 | 740 | 15 |
| A2 | 1250 | 15 | 1.40 | 2 | 30 | 760 | 18 |
| A3 | 1220 | 20 | 1.43 | 3 | 35 | 750 | 17 |
| A4 | 1250 | 15 | 1.46 | 2 | 32 | 780 | 20 |
| A5 | 1240 | 18 | 1.40 | 3 | 40 | 770 | 16 |
| A6 | 1260 | 12 | 1.43 | 2.2 | 38 | 760 | 15 |
| A7 | 1250 | 15 | 1.42 | 3.5 | 45 | 740 | 17 |
| A8 | 1230 | 20 | 1.46 | 1.51 | 20 | 770 | 18 |
| A9 | 1250 | 15 | 1.44 | 3.15 | 25 | 760 | 15 |
| A10 | 1230 | 18 | 1.46 | 1.8 | 30 | 755 | 16 |
| B1 | 1260 | 10 | 1.42 | 1.8 | 20 | 760 | 15 |
| B2 | 1250 | 15 | 1.46 | 1.51 | 20 | 780 | 20 |
| B3 | 1240 | 18 | 1.46 | 2 | 32 | 780 | 16 |
| B4 | 1240 | 18 | 1.42 | 3 | 30 | 770 | 18 |
| B5 | 1230 | 20 | 1.46 | 1.51 | 20 | 760 | 15 |
| B6 | 1230 | 20 | 1.35 | 1.8 | 30 | 760 | 15 |

An arc-shaped sample with a size of 2 mm*10 mm*55 mm was taken along the thickness direction of the steel tube wall from the seamless steel tubes of the above examples and comparative examples. After a standard V-shaped notch with a depth of 2 mm was formed on a side, values of impact power were obtained after impacting at −60° C., as listed in Table 3.

The criteria for evaluating whether the seamless steel tubes in the examples and comparative example can meet the requirements of the high strength and toughness seamless steel tube for an air bag are as follows: 1) tensile strength >850 MPa; 2) impact absorption power at −60° C.>15 J, 3) the low-temperature burst fracture at −60° C. shows tough fracture. That is, where a seamless steel tube meets the above requirements of 1) to 3) at the same, it is identified as "Pass"; otherwise, it is identified as "Not Pass". The mechanical properties of the seamless steel tubes in the examples and comparative examples are listed in Table 3.

As seen from Table 1 Table 2 and Table 3, the seamless steel tubes in Examples A1-A10 comprised the elements at the given amounts as mentioned in the embodiments of the present disclosure, and they were prepared by the method according to the present disclosure. The high strength and toughness seamless steel tubes for an automobile air bag in Examples A1-A10 had a tensile strength of 855 MPa or more, an elongation of 18% or more and a strength-toughness product of 14620 MPa*J or more. The lowest impact absorption power of the high strength and toughness seamless steel tubes for an automobile air bag was 17 J at −60° C. Meanwhile, they showed toughness fracture in hydroburst testing at −60° C. and no crack extends to any side of the steel tubes. However, since the seamless tubes in Comparative Examples B1-B6 comprised some elements with amounts out of the present disclosure, or they were not prepared according to the method of the present disclosure, at least one of the mechanical properties of the seamless tubes did not meet the requirement of the high strength and toughness seamless steel tube for automobile air bags.

TABLE 3

| No. | Tensile strength (MPa) | Elongation (%) | Impact absorption power at −60° C. (J) | Strength-toughness product* (MPa*J) | Hydroburst** | Pass/Not Pass |
|---|---|---|---|---|---|---|
| A1 | 860 | 18 | 17 | 14620 | 1 | Pass |
| A2 | 880 | 18 | 17 | 14960 | 1 | Pass |
| A3 | 870 | 19 | 17 | 14790 | 1 | Pass |
| A4 | 855 | 18 | 19 | 16245 | 1 | Pass |
| A5 | 860 | 20 | 18 | 15480 | 1 | Pass |
| A6 | 900 | 19 | 19 | 17100 | 1 | Pass |
| A7 | 870 | 19 | 21 | 18270 | 1 | Pass |
| A8 | 860 | 19 | 20 | 17200 | 1 | Pass |
| A9 | 855 | 19 | 20 | 17100 | 1 | Pass |
| A10 | 870 | 20 | 18 | 15660 | 1 | Pass |
| B1 | 750 | 12 | 18 | 13500 | 1 | Not Pass |
| B2 | 720 | 22 | 18 | 12960 | 1 | Not Pass |
| B3 | 900 | 12 | 12 | 10800 | 2 | Not Pass |
| B4 | 780 | 20 | 17 | 13260 | 1 | Not Pass |
| B5 | 790 | 20 | 17 | 13430 | 1 | Not Pass |
| B6 | 780 | 16 | 16 | 12480 | 1 | Not Pass |

*Strength-toughness product is the product of tensile strength and impact power.

**In the column of "hydroburst", "1" means that tough fracture occurs in hydroburst testing at −60° C. and no crack extends to any side of a steel tube; "2" means that brittle fracture occurs in hydroburst testing at −60° C. and a crack extends to some side of a steel tube.

According to the above tables, the technical solution of the present disclosure has obtained the seamless steel tube having large tensile strength, high strengthening-toughness product, good low-temperature impact performance and elongation by a combination of suitable composition, suitable cold working and suitable heat treatment. The seamless steel tube is especially suitable for manufacturing automobile air bags.

It should be noted that the above-listed examples are only specific embodiments of the present disclosure, it is apparent that the present disclosure is not limited to the above embodiments, and there are many similar variations. Those skilled in the art can derive or associate all of the variations that are directly derived or associated with the teachings of the present disclosure, and all these variations should fall in the protection scope of the disclosure.

What is claimed is:

1. A high strength and high toughness seamless steel tube for an automobile air bag, comprising the following elements, by weight:

C: 0.05-0.15%; Si: 0.1-0.45%; Mn: 1.0-1.9%; Ni: 0.1-0.6%; Cr: 0.05-1.0%; Mo: 0.05-0.2%; Cu: 0.05-0.50%; Al: 0.015-0.060%; Nb: 0.02-0.1%; V: 0.02-0.15%; the balance of Fe and inevitable impurities, wherein the steel tube has a tensile strength of ≥850 MPa, a low-temperature impact absorption power at −60° C. of ≥15 J, and an elongation of ≥8%, and wherein the steel tube is manufactured without quenching and tempering.

2. The high strength and high toughness seamless steel tube for the automobile air bag of claim 1, further comprising ≤0.005 wt % of B element.

3. The high strength and high toughness seamless steel tube for the automobile air bag of claim 1, wherein it has a wall thickness of ≥1.5 mm.

4. The high strength and high toughness seamless steel tube for the automobile air bag of claim 1, wherein it has an outer diameter of 15-50 mm.

5. The high strength and high toughness seamless steel tube for the automobile air bag of claim 1, wherein it has a microstructure of ferrite+lower bainite.

6. A method of producing the high strength and toughness seamless steel tube for an automobile air bag of claim 1, comprising the following steps:

(1) heating a tube blank and then soaking;

(2) hot piercing, reducing the diameter and the wall thickness of the tube blank with a stretch reducer and then cooling naturally;

(3) annealing, pickling, phosphating and saponifying;

(4) cold working to obtain a finished product size; and (5) carrying out stress relief annealing treatment.

7. The method of producing the high strength and toughness seamless steel tube for an automobile air bag of claim 6, wherein, in the above step (1), the tube blank is heated to 1220-1260° C. and is soaked for 10-20 minutes.

8. The method of producing the high strength and toughness seamless steel tube for an automobile air bag of claim 6, wherein, in the above step (4), the cold working is carried out by cold drawing or cold rolling.

9. The method of producing the high strength and toughness seamless steel tube for an automobile air bag of claim 6, wherein, in the above step (4), an extension coefficient of each run of the cold working is less than or equal to 1.5.

10. The method of producing the high strength and toughness seamless steel tube for an automobile air bag of claim 9, wherein, in the above step (4), an extension coefficient of last run of the cold working is larger than or equal to 1.4.

11. The method of producing the high strength and toughness seamless steel tube for an automobile air bag of claim 6, wherein, in the above step (5), a temperature of the stress relief annealing treatment is 680-780° C. and is held for 10-20 min.

* * * * *